United States Patent [19]

Pflingston

[11] 4,377,632

[45] Mar. 22, 1983

[54] DIFFUSION TRANSFER FILM UNITS WITH APPLICATION OF PROCESSING COMPOSITION BETWEEN DYE DEVELOPER LAYER AND SILVER HALIDE EMULSION LAYER

[75] Inventor: William J. Pflingston, Canton, Mass.

[73] Assignee: Polaroid Corporation, Cambridge, Mass.

[21] Appl. No.: 334,168

[22] Filed: Dec. 24, 1981

[51] Int. Cl.[3] ..... G03C 1/40; G03C 5/54

[52] U.S. Cl. ..... 430/218; 430/207; 430/212; 430/220; 430/224; 430/236

[58] Field of Search ..... 430/212, 207, 215, 224, 430/218, 220, 236

[56] References Cited

U.S. PATENT DOCUMENTS 2,983,606 5/1961 Rogers ..... 430/224

3,658,524 4/1972 Piesach ..... 430/212

*Primary Examiner*—Richard L. Schilling

*Attorney, Agent, or Firm*—Louis G. Xiarhos

[57] ABSTRACT

Diffusion transfer film units and a diffusion transfer process operative therein are described which are capable of providing relatively high resolution monochromatic dye developer transfer images.

31 Claims, 2 Drawing Figures

DIFFUSION TRANSFER FILM UNITS WITH APPLICATION OF PROCESSING COMPOSITION BETWEEN DYE DEVELOPER LAYER AND SILVER HALIDE EMULSION LAYER

BACKGROUND OF THE INVENTION

The present invention relates to photographic products and processes and, in particular, to diffusion transfer photographic products and processes adapted to provide relatively high resolution monochromatic images in dye developer.

U.S. Pat. No. 2,983,606 discloses and claims a method for forming color images by diffusion transfer wherein the color-providing substances are dye developers. As set forth in detail in that patent, a photosensitive element comprising an exposed photosensitive silver halide emulsion is developed by application of a liquid processing composition and an imagewise distribution of diffusible, unoxidized dye developer is formed as a function of development. At least a portion of such diffusible dye developer is transferred to an image-receiving layer positioned in superposed relationship with the silver halide emulsion. The image-receiving layer is dyed by the dye developer such that a positive color image of the developed latent image in the silver halide emulsion is formed therein. At the end of a suitable imbibition period, the image-receiving layer is separated from its superposed relationship with the silver halide emulsion to permit viewing of the color transfer image.

As disclosed in the aforementioned U.S. patent, a dye developer is a compound which contains the chromophoric system of a dye and a silver halide developing function. By "a silver halide developing function" is meant a grouping adapted to develop exposed silver halide. In the method of of color image formation described in the patent, the dye developer or, more specifically, the silver halide developing function thereof, undergoes oxidation in exposed areas of the silver halide emulsion as a consequence of development to form a product which is substantially less mobile in the processing composition than is unoxidized dye developer. In unexposed and partially exposed areas of the silver halide emulsion, the dye developer is unreacted and, thus, substantially maintains its original mobility in the processing composition so as to provide an imagewise distribution of unoxidized diffusible dye developer as a function of the point-to-point degree of exposure of the silver halide emulsion. As noted above, at least a portion of this imagewise distribution is transferred to a superposed image-receiving layer to form a positive color image therein.

Typically, film units employing dye developers as color providing substances in a diffusion transfer process and adapted for separation of the image-receiving layer subsequent to processing are comprised of a photosensitive element containing at least one silver halide emulsion layer having a dye developer associated therewith and an image-receiving element containing the image-receiving layer. The respective elements are superposed subsequent to exposure and, as they are brought into superposition, an aqueous alkaline processing composition is spread therebetween to initiate development. After suitable imbibition, the image-receiving element is stripped or peeled away from the photosensitive element. Such film units may be adapted for formation of monochromatic color images and, accordingly, contain a single silver halide-dye developer combination or they may provide multicolor images and, accordingly, contain two or more silver halide-dye developer combinations. Generally, each dye developer possesses, at least subsequent to transfer, a spectral absorption range substantially complementary to the predominant sensitivity range of its associated silver halide emulsion layer.

In such film units, it is intended that the imagewise distribution of dye developer remain substantially undisturbed during transfer to the image-receiving layer so as to substantially preserve the original correspondence between the imagewise distribution of diffusible dye developer and the developed latent image. Ideally, the dye developer should diffuse over the shortest path between the superposed silver halide and image-receiving layers, i.e., a path normal to the plane of these parallel layers. In practice, virtually all of the dye developer in the imagewise distribution does diffuse in the intended manner, thereby providing a substantial and, generally, acceptable degree of correspondence between the color transfer image and the developed latent image. Nonetheless, some lateral diffusion of dye developer, i.e., diffusion oblique to the intended path, can and, generally, does occur. The resultant disturbance of the imagewise distribution of the dye developer is manifested in the transfer image by less than optimal resolution or "edge sharpness" and imposes a limitation on the capability of the film to resolve or reproduce fine detail in the photographed object. Although not unacceptably restrictive for most applications, this limitation may render film units of the aforedescribed structure unsuitable or marginally suitable for certain specialized applications requiring relatively high resolution images, e.g., certain technical or graphic arts applications.

SUMMARY OF THE INVENTION

The present invention relates to diffusion transfer film units and a diffusion transfer process operative therein which are capable of providing relatively high resolution monochromatic dye developer transfer images. The film units and process of this invention have been found to permit formation of monochromatic dye developer transfer images of desired high quality and have also been found to permit limitation of lateral diffusion of the diffusible dye developer employed for purposes of transfer image formation to a level sufficiently minimal to provide transfer images possessing desired and highly favorable resolution characteristics.

For a fuller understanding of the present invention reference should be had to the following detailed description taken in connection with the accompanying drawings.

DETAILED DESCRIPTION OF THE INVENTION

Figure 1:
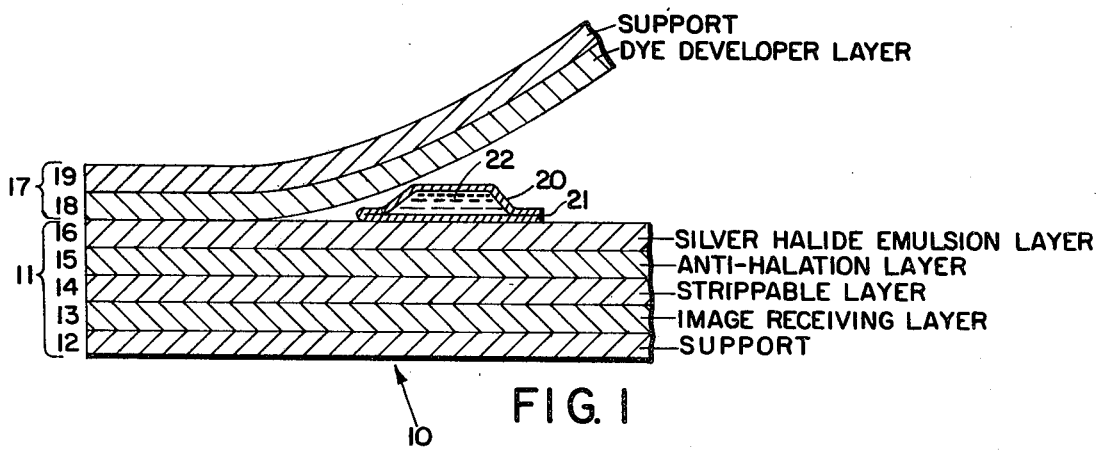
FIG. 1 is a diagrammatic enlarged cross-sectional view of a preferred film unit of the present invention illustrating the association of film unit elements employed for production of a monochromatic transfer image in accordance with the present invention, the thickness of the various materials being exaggerated and non-proportional.

As indicated above, the present invention relates to diffusion transfer products and processes capable of providing dye developer transfer images characterized by a relatively high degree of resolution. Specifically, the present invention relates to diffusion transfer products and processes particularly adapted to limit the lateral diffusion of the diffusible dye developer in an imagewise distribution thereof formed as a function of development, during transfer of the dye developer to an image-receiving layer, to a degree sufficiently low to permit the formation of a transfer image possessing a desired and relatively high degree of resolution. Limitation of the degree of lateral diffusion of the dye developer provides for increased correspondence between the distribution of dye developer employed to form the transfer image, i.e., the distribution arriving at the image-receiving layer, and the latent image developed to effect formation of the imagewise distribution of diffusible dye developer. Viewed somewhat differently, the original imagewise distribution of diffusible dye developer, formed in the vicinity of the silver halide emulsion layer, is better maintained during transfer to the image-receiving layer. As a result, the ability of the film to distinguish and reproduce, i.e., to resolve, fine detail in a photographed object, e.g., the ability to reproduce an array of closely spaced lines as distinct and alternating light and dark areas, is substantially increased.

Limitation of the lateral diffusion of diffusible dye developer is achieved in the instant film units by providing the imagewise distribution of diffusible dye developer with a relatively short path to the image-receiving layer which can be rapidly traversed and which is not inclusive of a layer of processing composition. The film units of this invention comprise a photosensitive element comprising a support carrying on one surface, in order, an alkaline processing solution permeable image-receiving layer, a layer adapted to permit separation of the image-receiving layer and support, as a unit, from the film unit after a suitable imbibition period, i.e., a strippable layer which allows the image-receiving layer-support unit to be stripped or peeled away from the film unit after processing, and a photosensitive silver halide emulsion layer; a dye developer element comprising a support carrying at least one dye developer layer, the dye developer element and photosensitive element being superposed or adapted to be superposed with their respective supports outermost; and a rupturable container retaining an aqueous alkaline processing composition and fixedly positioned to effect, upon rupture, discharge of the processing composition between the photosensitive and dye developer elements.

In a preferred embodiment, the film units of this invention also comprise an anti-halation layer contained in either the photosensitive element or the dye developer element.

In the formation of a color transfer image in the instant film units, the processing composition is distributed between the superposed elements and permeates the dye developer layer with resultant solubilization of at least a portion of the dye developer. At least a portion of the solubilized and diffusible dye developer transfers, in an essentially uniform distribution, through the processing composition layer to the photosensitive element wherein it is substantially immobilized in an imagewise manner as a function of development of the silver halide, such that an imagewise distribution of diffusible dye developer is formed. At least a portion of the imagewise distribution diffuses to the image-receiving layer to provide therein a color transfer image. After a suitable imbibition period, the image-receiving layer and the support of the photosensitive element are peeled or stripped away from the film unit, as a unitary structure, to permit viewing of the transfer image.

FIG. 1 illustrates a preferred film unit constructed in accordance with the present invention. The film unit 10 is shown to comprise a photosensitive element 11 comprising a support 12 carrying an image-receiving layer 13, a strippable layer 14, an anti-halation layer 15, and a silver halide emulsion layer 16; a dye developer element 17 comprising a support 19 carrying a dye developer layer 18; and a rupturable container 20 comprising a marginal seal 21 and containing an aqueous alkaline processing composition 22. Photosensitive element 11 and dye developer element 17 are shown being brought into superposition with the container 20 situated therebetween. The container 20 is shown affixed initially to the inner surface of photosensitive element 11, although it may be affixed as well to the inner surface of dye developer element 17. The rupturable container is positioned transverse to element 11 and closely adjacent a leading edge thereof such that application of a compressive force thereto, e.g., by passage of the superposed elements and container through a pair of closely spaced rollers, ruptures the marginal seal 21 of the container to effect distribution of processing composition 22 as a uniform layer essentially coextensive and in contact with dye developer layer 18 and silver halide emulsion layer 16.

The photosensitive element 11 and dye developer element 17 can be brought into superposition prior to exposure provided that the silver halide can be adequately exposed through the dye developer element, i.e., provided that the element, and particularly the dye developer layer, is sufficiently transparent to the wavelength(s) of incident radiation intended for recordation in the silver halide layer. In a highly preferred embodiment, the respective elements are superposed subsequent to exposure, thereby obviating the aforementioned provision, and, in addition, providing for minimized internal reflection during exposure. In accordance with this latter embodiment, the processing composition can be spread between the elements as or after they are brought into superposition.

As mentioned previously, in a preferred embodiment the film units of this invention comprise an anti-halation layer contained in either the photosensitive element, e.g., as in the preferred film unit illustrated by FIG. 1, or in the dye developer element. It will be understood that the provision of an anti-halation layer in the present film units will generally result in increased resolution in the latent image resultant from photoexposure of the silver halide and, thus, will generally result in a higher degree of resolution in the dye developer transfer image.

Most preferably, the anti-halation layer is contained in the photosensitive element. It will be recognized that the positioning of the anti-halation layer in the photosensitive element is consistent with the preferred practice of superposing the respective film unit elements subsequent to exposure. With regard to FIG. 1, the positioning of anti-halation layer 15 between silver halide emulsion layer 16 and strippable layer 14 provides a particularly preferred arrangement in that photoexposure of the silver halide from the emulsion side of photosensitive element 11 is permitted and minimal internal reflection during photoexposure is realized. However, the anti-halation layer can also be positioned in the photosensitive element on that side of the silver halide emulsion layer opposite the photosensitive element support, e.g., as an overcoat layer, provided that the support is sufficiently transparent to permit exposure of the silver halide therethrough.

The antihalation layer can also be positioned in the dye developer element, provided that the respective film unit elements are superposed prior to exposure and the photosensitive element support is transparent. The anti-halation layer can be a discrete layer coated on the support of the dye developer element or it can be in the form of an opaque support. The dye developer layer can function to decrease halation of those wavelengths of incident light which it is capable of absorbing.

Figure 2:
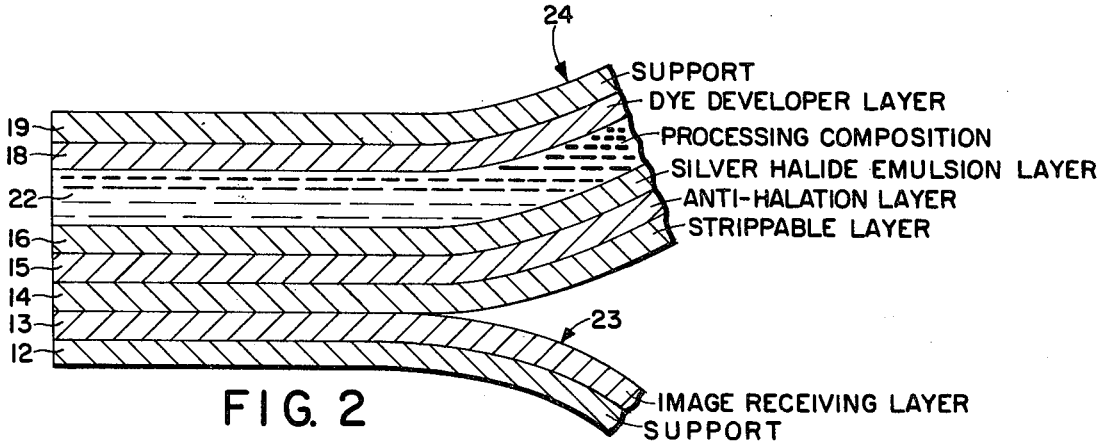
FIG. 2 is a similar view of the film unit of FIG. 1 shown subsequent to processing and illustrating the mode of separation employed to permit viewing of the monochromatic transfer image.

Subsequent to exposure, film unit 10 is processed by effecting distribution of processing composition 22 between superposed elements 11 and 17 in the aforesaid manner. At least a portion of the dye developer in layer 18 is solubilized by the distributed processing composition and at least a portion of the solubilized dye developer transfers to silver halide layer 16 wherein it is immobilized as a function of development, as described above. The resultant imagewise distribution of diffusible dye developer transfers through strippable layer 14 and anti-halation layer 15 to image-receiving layer 13 wherein it is precipitated, mordanted, or otherwise fixed to provide a monochromatic transfer image. FIG. 2 illustrates the film unit 10 subsequent to processing and shows the distributed processing composition in a layer 22. The figure illustrates separation of a positive element 23, comprising support 12 and image-receiving layer 13, and having the transfer image fixed therein, from a negative element 24 to permit viewing of the transfer image. If the support 12 is transparent, the image may be viewed as a transparency. Alternatively, if a reflective background is provided, e.g., by support 12 or a layer positioned between support 12 and image-receiving layer 13, such as a layer of titanium dioxide, the image is viewed as a reflection print.

The strippable layer 14 is shown as being maintained as a discrete layer in the negative element 24 subsequent to processing of the film unit and separation of the positive element 23 therefrom. However, as further detailed hereinafter, the strippable layer may be comprised of materials which undergo chemical or physical changes during processing which facilitate the intended separation of the positive element. The changes may effectively destroy the integrity of the layer. Accordingly, depiction of the strippable layer as a discrete layer adhering to the negative element during separation is intended to illustrate that the layer or any residue thereof existent subsequent to processing are largely retained in the negative element. A portion of the strippable layer or residue may, however, adhere to the positive element provided that any effect on the transfer image or viewing thereof is not unacceptable.

In the film units of the present invention comprising the dye developer element and photosensitive element in superposition prior to exposure, adhesive means may be employed to maintain the superposed elements in a fixed relationship, e.g., adhesive means extending along at least a part of the periphery of the superposed elements. The elements may also be maintained in a fixed relationship by providing a binding member, e.g., a pressure sensitive tape, extending along one or more of the edges of the superposed elements, provided that intended separation of the image-receiving layer-support unit is still permitted subsequent to processing.

The rupturable container employed in the instant film units can be of the type shown and described in any of U.S. Pat. Nos. 2,543,181; 2,634,886; 2,653,732; 2,903,951 3,056,491; 3,056,492; 3,152,515; 3,415,644; and the like. Such containers and their utilization in diffusion transfer products and processes are well known and, accordingly, are not seen as requiring further elucidation herein. It may be noted, however, that the container may be transversely positioned between the superposed photosensitive and dye developer elements, closely adjacent a leading edge thereof, e.g., as shown in cross-section in FIG. 1 in exaggerated dimension, or it may be fixedly positioned external to the superposed elements and extending transverse a leading edge thereof, the container being so retained in association with the superposed elements as to permit distribution of the processing composition in the intended manner.

As noted above, the film units of this invention comprise the photosensitive element and dye developer element in superposition or adapted for superposition. In accordance with the latter embodiment, the elements can be held in association with one another in a manner permitting superposition thereof. For example, the elements can be joined together at a leading edge by hinged fastening means which permit intended superposition. The elements can also be held in association with one another in any one of the known film pack arrangements, e.g., those disclosed in U.S. Pat. Nos. 2,903,951; 3,002,437; 3,080,805; and 3,433,636; the dye developer element being substituted for the image or print receiving elements described in these patents. The elements can also be retained or positioned in a suitable processing apparatus, e.g., an apparatus comprising transport means which can be activated to bring the elements into superposition subsequent to exposure.

In a preferred embodiment, the film units of this invention also comprise one or more auxiliary or accelerating developing agents, e.g., any of the auxiliary or accelerating developing agents heretofore disclosed for use in diffusion transfer processes. Useful auxiliary developing agents include 1-phenyl-3-pyrazolidone and those of the benzenoid class, i.e., developing agents containing an aryl nucleus substituted in the ortho and para positions, with respect to each other, by hydroxyl and/or amino groups, including substituted amino groups. Suitable developing agents within this class include p-methylaminophenol, 2,4-diaminophenol, p-benzylaminophenol, and developing agents comprising a hydroquinone moiety, e.g., hydroquinone, phenylhydroquinone, trimethylhydroquinone, and 4'-methylphenylhydroquinone. Such auxiliary developing agents can be included, at least in part, in the processing composition or they may be incorporated, at least in part, in the silver halide layer, the dye developer layer, the anti-halation layer or in any other auxiliary layer or layers of the film unit. The apparent functioning of auxiliary developing agents in diffusion transfer processes employing dye developers has been disclosed in a number of publications, including U.S. Pat. Nos. 2,983,606; 3,039,869; and 3,415,644. Apparently, the auxiliary developing agent develops the silver halide and is oxidized to a product which in turn oxidizes the dye developer, converting it to the desired oxidized and immobile species. In general, the employment of an auxiliary developing agent in conjunction with a dye developer provides improved diffusion control of the dye developer, which can be manifested by, for example, improved contrast and cleaner highlights in the transfer image.

As indicated previously, in a typical diffusion transfer film unit adapted for separation of the image-receiving layer subsequent to processing, the processing composition is distributed between superposed image-receiving and photosensitive elements. Although the processing composition permeates the layers of the film unit to initiate transfer image formation, distribution thereof nonetheless results in formation of a relatively thick liquid processing composition layer, existent at least through the early part of the processing interval, through which an imagewise distribution of dye developer is required to transfer to gain access to the image-receiving layer of the film unit. Transfer through this relatively thick layer, comprised of a solution in which the unoxidized dye developer is soluble and diffusible, apparently provides a substantial potential for lateral diffusion of the dye developer. In the film units of this invention, transfer of the imagewise distribution of dye developer through the processing composition layer is avoided. Rather, the dye developer is dissolved out of an element separate from that containing the silver halide emulsion and the dissolved dye developer is transferred through the processing composition in an essentially uniform and non-imagewise distribution. It should be understood that lateral diffusion of dye developer during such a non-imagewise transfer is immaterial to the resolution obtained in the transfer image. The imagewise distribution of dye developer employed for image formation purposes is formed subsequent to such transfer and is provided relatively rapid access to the image-receiving layer over a short diffusion path which does not include the processing composition layer. In view of the aforementioned potential for lateral diffusion associated with traversal of the processing composition layer, avoidance of transfer of dye developer across this layer is believed to materially contribute to the relatively high resolution capable of being provided by the film units of this invention.

The discovery that a dye developer can be dissolved out of a layer of an element separate from a photosensitive element and transferred through a processing composition layer to the superposed photosensitive element in a quantity and at a rate sufficient to provide high quality images is considered an important aspect of this invention. With particular regard to the preferred film units of this invention comprising an auxiliary developing agent, it has been found that dye developer can be dissolved out of the dye developer element and transferred to the vicinity of the silver halide layer in the photosensitive element at a rate consistent with development of the silver halide by the auxiliary developing agent, i.e., subsequent to substantial development by the auxiliary developing agent but prior to any significant degree of lateral diffusion of the oxidized auxiliary developing agent, such that color transfer images characterized by highly favorable maximum and minimum image densities and by a relatively high degree of image resolution can be provided.

The strippable layer employed herein should initially provide a high degree of adhesion between the layers adjacent thereto. During separation, the layer should cleanly release from the image-receiving layer-support unit containing the transfer image, e.g., as illustrated in FIG. 2. Materials useful as strippable layers in diffusion transfer products are well known. In general, such materials provide the desired initially high degree of adhesion and then, during processing with an aqueous alkaline solution, undergo a physical or chemical change, e.g., solubilization or swelling, which facilitates the intended separation. As examples of materials useful in such layers, mention may be made of cellulose acetate hydrogen phthalate, hydroxyethylcellulose, polyvinyl pyrrolidone, and acid functional waxes such as methyl acrylate/acrylic acid copolymers.

In the instant film units, separation in the intended manner results in those layers positioned between the strippable layer and the dye developer layer adhering to the dye developer element. For example, with regard to FIGS. 1 and 2, the anti-halation layer 15, silver halide layer 16 and processing composition layer 21 adhere to the dye developer element 17 during separation, effectively forming the negative element 24.

It is preferred that the strippable layer and any other layers interposed between the silver halide layer and the image-receiving layer be sufficiently permeable to permit a relatively rapid transfer of the imagewise distribution of dye developer to the image-receiving layer. In general, the rapid transfer of the dye developer through these layers will tend to minimize lateral diffusion and, accordingly, promote increased resolution in the transfer image. The strippable layer may initially possess the desired degree of permeability or it may undergo conversion to a condition of sufficient permeability in the presence of the aqueous alkaline processing composition. Normally, changes undergone by the layer to facilitate separation will also function to increase the permeability thereof to dye developer.

Materials preferred for use in the strippable layers of this invention include a mixture of cellulose acetate hydrogen phthalate and the resinous plasticizer Resoflex 296, commercially available from Cambridge Industries, Watertown, MA. More preferably, the strippable layer is comprised of a mixture of a water soluble polymer, e.g., hydroxyethylcellulose or carboxymethylcellulose, and an aqueous dispersion of a hydrophobic material, e.g., a dispersion of polyethylene particles. Strippable layers comprising the latter mixture and their use in diffusion transfer products are described in the copending U.S. patent application Ser. No. 277,616 of M. Berger et al., filed June 26, 1981.

As indicated in Examples 1–4 hereof, strippable layers containing the preferred materials permit dye developer transfer at a rate consistent with the provision of relatively high resolution transfer images and, in addition, provide good initial adhesion between adjacent layers and permit a clean separation of the image-receiving layer-support unit at the end of a suitable imbibition period.

Any suitable anti-halation dye, pigment, or other material can be employed in an anti-halation layer used in the present instant film units. The anti-halation material can be dispersed or suspended in a suitable carrier and should be substantially incapable of transfer to the image-receiving layer prior to or during processing, at least in a colored form. If the anti-halation layer is positioned between the strippable layer and the silver halide layer, it preferably comprises the anti-halation material dispersed in a carrier which is permeable to and swellable in the presence of the processing composition, e.g., a polyvinylalcohol or gelatin carrier. In general, such properties in the carrier facilitate diffusion of the imagewise distribution of dye developer through the antihalation layer with resultant minimization of lateral diffusion. A preferred anti-halation layer is comprised of carbon black dispersed in gelatin.

The processing composition employed herein comprises at least an aqueous solution of an alkaline material, for example, sodium or potassium hydroxide and the like. The pH of the processing composition must be an alkaline pH at which the dye developer employed is soluble and diffusible. Generally, the pH of the processing composition is at least 12 and frequently is about 14 or greater. It is highly preferred to include in the processing composition a viscosity-increasing compound constituting a film-forming material which facilitates uniform spreading of the composition and provides maintenance of the spread composition as a structurally stable layer subsequent to distribution. The employment of such viscosity-increasing materials in diffusion transfer processing compositions is well known and is disclosed in, for example, U.S. Pat. Nos. 2,603,565; 2,983,606; 3,415,644; 3,776,726; 3,841,879; 4,021,241; and 4,202,694. Viscosity-increasing materials disclosed therein and preferred for use in the present invention comprise high molecular weight polymers such as polymeric, water soluble ethers which are inert to an alkaline solution such as, for example, hydroxyethylcellulose, sodium carboxymethylcellulose or carboxymethylhydroxyethylcellulose. Other film-forming materials or thickening agents whose ability to increase viscosity is substantially unaffected if left in solution for a long period of time may also be employed herein. The film forming material is preferably contained in the processing composition in such suitable quantities as to impart to the composition a viscosity in excess of 100 cps. at a temperature of approximately 24° C. and preferably in the order of 100,000 cps. to 200,000 cps. at that temperature.

In addition to the aforementioned layers, the film units of this invention can also comprise a layer containing an immobile, acid reactive reagent, i.e., an alkali neutralization layer capable of reacting with an neutralizing at least a portion of the alkali provided by the processing composition. The neutralization layer should comprise a sufficient amount of acid reactive reagent to effect downward adjustment of the environmental pH of the image-receiving layer to a pH of at least 11 or lower at the end of the imbibition period, and preferably to a pH of about 5 to 8 within a short time after imbibition. As disclosed in U.S. Pat. No. 3,362,819 and in a number of other patents, downward adjustment of the environmental pH of a diffusion transfer process image-receiving layer to such levels, subsequent to substantial transfer image formation, can provide a marked improvement in both image stability and quality. Preferred acid reactive reagents for employment herein are polymeric acids, e.g., those specifically mentioned in U.S. Pat. No. 3,362,819. Included among the polymeric acids which are particularly useful are polyacrylic acid and partial esters of polyethylene/maleic anhydride copolymers.

The rate of pH reduction by the neutralization layer should be controlled so as to not interfere with the intended development of the silver halide and image transfer of the unoxidized dye developer. The pH of the image-receiving layer should be maintained at a level of pH 12 to 14 until the transfer image has been substantially formed and thereafter be reduced to at least about pH 11 or lower before separation of the image-receiving layer-support unit. Premature pH reduction, as evidenced, for example, by a decrease in image dye density, may be prevented by controlling the rate of availability of the acid groups to the alkali, e.g., by modulating the rate of diffusion of alkali ions into the layer. Preferably, premature pH reduction is prevented by employment of a spacer or timing layer disposed intermediate the neutralization layer and the distributed processing composition. This layer "time" controls the pH reduction by the neutralization layer by delaying or retarding access of the alkali to the neutralization layer to a predetermined extent. The employment of timing layers for control of premature pH reduction is well known and is disclosed in previously referenced U.S. Pat. Nos. 3,362,819; 3,415,644; 3,419,389; 3,575,701; and numerous other patents. Materials disclosed as being capable of employment in such layers include polyvinylalcohol; partial acetals of polyvinylalcohol such as a partial polyvinyl butyral; and gelatin. The timing layer can also be of the "hold-release" variety and accordingly comprise any of the $\beta$-eliminating polymers disclosed in U.S. Pat. Nos. 4,201,587; 4,288,523; and 4,297,431.

The timing and neutralization layers may be contained in the photosensitive element positioned between the support and the image-receiving layer. It will be appreciated that the resultant positive element separated from the film unit at the end of the imbibition period will be comprised of these layers in addition to the support and image-receiving layer. Alternatively, the timing and neutralization layers may be contained in the dye developer element, positioned between the support and the dye developer layer.

The image-receiving layer may comprise one or more of the materials previously disclosed for utilization in such layers, e.g., gelatin, polyacrylamide, polyvinylalcohol, poly-4-vinylpyridine, or one or more polymeric mordants comprising a quaternary nitrogen group pendant to a polymer backbone, such as the polymeric mordants disclosed in U.S. Pat. Nos. 3,625,694; 3,698,896; 3,709,690; 3,770,439; 3,994,424; 3,958,995; 4,071,366; 4,124,388; and 4,193,800. Preferred materials are the graft copolymers disclosed in U.S. Pat. Nos. 3,756,814 and 4,080,346, particularly those graft copolymers comprising a moiety providing a mordant capability grafted to a hydroxyethylcellulose backbone and more particularly a graft copolymer comprising a vinylpyridine and a vinylbenzyl ammonium halide grafted to a hydroxyethylcellulose backbone.

Silver halides which may be employed in the silver halide emulsion layer include silver chloride, silver bromide, silver iodide and mixed silver halides such as silver chlorobromide, silver chloroiodobromide, and silver iodobromide. The silver halide is dispersed in a water-permeable and swellable binder material such as an appropriate synthetic polymer or, preferably, a gelatin matrix. The silver halide may be monochromatically or panchromatically sensitized by optical sensitizing dyes by procedures known in the art. Preferred silver halide emulsions are the small grain size emulsions wherein the mean volume diameter of the silver halide grains is less than about one micron, such emulsions tending to provide better resolution in the transfer image than larger grain size materials.

It has been found that a relatively low speed small grain size silver halide emulsion can be employed in the film units of this invention comprising an auxiliary developer to provide high quality images, particularly in terms of minimum image density ($D_{min}$). Thus, the silver halide emulsion employed in the film units of this invention described in Examples 1 to 4 hereinafter provides images characterized by favorable $D_{max}$ and $D_{min}$ values whereas the same emulsion employed in a negative element in association with a dye developer, as described in Example 5, yields an image having a substantially higher $D_{min}$. While this result is not fully understood, and while not wishing to be bound by any particular theory, it is believed that the provision of high quality images in Examples 1 to 4 is due to the time sequencing involved in dissolving the dye developer, transferring same to the vicinity of the silver halide layer, developing the latent image with the auxiliary developer, and cross-oxidizing the dye developer. Apparently, the timing is such that the dye developer is not contacted with the silver halide or oxidized auxiliary developer until substantial development of the latent image has occurred whereas, in the film unit of Example 5, the dye developer diffuses to the silver halide layer prematurely with a resultant substantially lower degree of dye diffusion control.

Negative or positive transfer images can be provided in the film units of this invention depending on the type of silver halide emulsion employed. Thus, positive color transfer images are provided in those film units employing conventional negative-working silver halide emulsions, i.e., emulsions wherein a developable latent image is formed in terms of areas of photoexposure. Negative color transfer images are provided in those film units employing direct positive emulsions, i.e., emulsions wherein the developable latent image existent subsequent to exposure is in unexposed areas.

Inasmuch as both negative and positive images may be provided in the film units of this invention, the terms "positive image", "positive element", and "negative element", as used herein, should not be interpreted in a restrictive sense. These terms are primarily illustrative, in that they define the transfer image as being reversed, in a positive-negative sense, with respect to the latent image formed in the silver halide emulsion layer. Thus, for example, consistent with the employment of a direct positive emulsion herein, the "positive element" 23 in FIG. 2 may comprise a negative transfer image and the "negative element" 24 may comprise a developed positive latent image.

A wide variety of dye developers particularly adapted for use in diffusion transfer processes has been disclosed. Considerations which may be relevant to the choice of a particular dye developer herein include, for example, the color desired in the transfer image; the stability of the dye developer, particularly with regard to the stability of the transfer image to incident radiation; and the image characteristics obtained with a given dye developer, e.g., the maximum and minimum image densities. In general, dye developers are constructed to possess spectral absorption characteristics, at least subsequent to transfer, which render the material essentially either yellow, magenta or cyan in color. However, it is within the scope of the present invention to employ other than yellow, magenta, or cyan dye developers, e.g., red, green, blue, or black in color. Moreover, a combination of two or more dye developers may be initially disposed in the dye developer element, either in the same or in separate layers, such that a desired color may be provided in the monochromatic transfer image, e.g., the employment of magenta and yellow dye developers capable of providing, in combination, a desired red transfer image.

The dye developer layer can be coated in the dye developer element by disposing a solution of the dye developer on the element support and evaporating the solvent. Preferably the dye developer layer is provided by coating a solid dispersion of the dye developer in a polymeric binder which, when coated and dried, is permeable to and swellable in the presence of the alkaline processing composition. The dye developer dispersion may be prepared by known methods, e.g., those described in U.S. Pat. No. 3,438,775. Any natural or synthetic polymer which possesses the prescribed permeability and swellability, is nonsubstantive to the selected dye developer, photographically innocuous, and provides sufficient adhesion to adjacent layers may be employed as the stated binder material. A particularly well known and preferred binder material is gelatin. The amount of dye developer and carrier employed in the dye developer layer can vary as necessary for provision of desired image characteristics and optimal amounts and proportions may be determined by relatively simple trial and error experimentation.

The film units of this invention may comprise layers in addition to those specifically referred to above, e.g., subcoats adapted to facilitate coating of one or more of the above mentioned layers. In a preferred embodiment, the photosensitive element comprises a protective topcoat layer, e.g., coated on the exposed surface of the silver halide emulsion layer, comprising a protective synthetic or naturally occurring polymer. A preferred material is gelatin. Such a layer may provide one or more protective functions such as decreasing the pressure sensitivity of the photosensitive element or serving as an anti-abrasion coating.

The supports employed in the photosensitive and dye developer elements of this invention may be opaque or transparent as appropriate for an intended method of exposure, processing, or viewing of the transfer image. The supports are preferably comprised of flexible sheet materials, e.g., paper or polymeric films of both the natural and synthetic types. Especially suitable sheet materials comprise flexible synthetic polymers such as polymethacrylic acid, methyl and ethyl esters; vinyl chloride polymers; polyvinyl acetals; polyamides such as nylon; polyesters such as the polymeric films derived from ethylene glycol terephthalic acid; and polymeric cellulose derivatives such as cellulose acetate, triacetate, nitrate, propionate, butyrate, acetatebutyrate, or acetate propionate; polycarbonates; polystyrenes and the like.

In general, the film units of this invention can be fabricated employing conventional coating and assembly methods. Coating aids such as surfactants, thickeners, and dispersants may be employed to facilitate coating the various layers of the film unit elements.

The present invention is further illustrated in the following Examples which are illustrative only and not intended to be of limiting effect.

EXAMPLE 1

A photosensitive element was prepared by coating, in order, on a gelatin subcoated transparent polyethylene glycol terephthalate film base, the following layers:

(1) an image-receiving layer of a graft copolymer of 2.2 parts by weight of 4-vinylpyridine and 1 part by weight of p-vinylbenzyltrimethylammonium chloride on 2.2 parts by weight of hydroxyethylcellulose at a coverage of about 300 mg./ft.$^2$ and 1,4-butanediol diglycidyl ether at a coverage of about 5 mg./ft.$^2$;

(2) a strippable layer comprising a mixture of hydroxyethylcellulose (commercially available from Hercules, Inc., Wilmington, DE., under the trade name Natrasol 250M) and a non-ionic aqueous dispersion of polyethylene particles having a solids content of 25% (commercially available from Michelman Chemicals Inc., Cincinnati, OH., as Michem Emulsion No. 68725M) at a coverage of about 30 mg./ft.$^2$ of polyethylene particles;

(3) an anti-halation layer comprising carbon black dispersed in gelatin at a coverage of about 15 mg./ft$^2$ of carbon black and about 30 mg./ft.$^2$ of gelatin;

(4) a layer of a panchromatically sensitized negative working 0.7$\mu$ gelatino silver iodobromide emulsion at a coverage of about 125 mg./ft.$^2$ of silver and about 103 mg./ft.$^2$ of gelatin;

(5) a layer of gelatin and succindialdehyde at a coverage of about 30 mg./ft.$^2$ of gelatin and about 2.5 mg./ft.$^2$ of succindialdehyde.

A dye developer element was prepared by coating a gelatin subcoated transparent polyethylene glycol terephthalate film base with a layer of a gelatin dispersion of a yellow dye developer of the formula

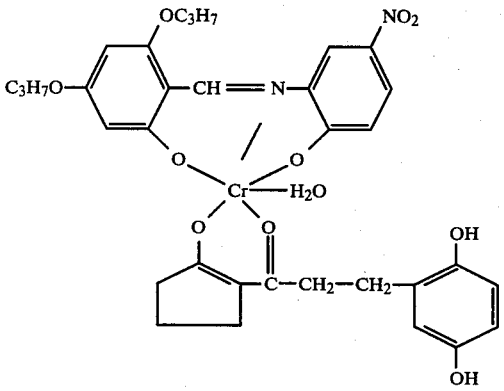

at a coverage of about 30 mg./ft.$^2$ of yellow dye developer and about 30 mg./ft.$^2$ of gelatin. A rupturable container retaining an aqueous alkaline processing composition comprising

| | |
|---|---|
| Potassium hydroxide | 5.0 g. |
| Benzotriazole | 0.5 g. |
| N—phenethyl-α-picolinium bromide | 0.1 g. |
| 6-methyluracil | 0.1 g. |
| Trimethylhydroquinone | 1.0 g. |
| Carboxymethyl hydroxyethyl cellulose | 2.0 g. |
| Zinc nitrate | 0.6 g. |
| Water | 90.7 g. |

was affixed to the exposed surface of the dye developer layer extending transverse the dye developer element and closely adjacent one edge thereof.

The photosensitive element was given a 2 meter-candle-second exposure through a resolution test target, specifically, a target containing the standard U.S. Air Force 1951 resolution test pattern. The test pattern comprised numerous arrays of dark bars on a clear background with the width and length of the bars and the spacing therebetween being progressively smaller in each array. Each array consisted of two sets of three parallel rectangular bars of equal width and height with the space between the bars equal to their width. The sets were oriented at 90° to each other, i.e., the bars in one set were horizontal and those in the other were vertical. Each array was calibrated to correspond to a particular number of cycles per millimeter, where one bar and one space equal one cycle. Exposure through such a target and examination of the resultant image to determine the smallest or finest distinguishable array constitutes a standard method for determination of a film unit's resolution or "resolving power". The resolving power is expressed in terms of the number of cycles per millimeter corresponding to the finest distinguishable array, such number indicating the maximum number of cycles per millimeter distinguishable by the film unit.

Subsequent to exposure, the photosensitive element and dye developer element were superposed in face-to-face relation with their respective supports outermost and with the rupturable container between the superposed elements and closely adjacent the leading edge thereof. The resultant structure was passed through a pair of pressure rollers positioned at a distance of about 0.0018 inch to effect rupture of the container and distribution of the processing composition between the superposed elements. After imbibition at room temperature for about one minute, the film unit was cleanly stripped apart to yield a transparent yellow image-bearing positive element and a negative element. The positive yellow image was visually examined through a stereomicroscope at a magnification of 70× to determine the finest distinguishable array therein. Pursuant to such examination, the resolving power of the film unit, i.e., the resolution in the transfer image, was determined to be about 40 cycles per millimeter. The image had a maximum reflection density to blue light of about 1.25 and a minimum reflection density to blue light of about 0.12 when placed against a white tile background.

EXAMPLE 2

A film unit was prepared, exposed, and processed in the manner described in Example 1 and the resolution of the monochromatic transfer image determined in the manner described in that Example. The film unit was identical to that described in Example 1 except that, instead of the yellow dye developer layer, the dye developer element comprised a layer of a gelatin dispersion of a magenta dye developer of the formula

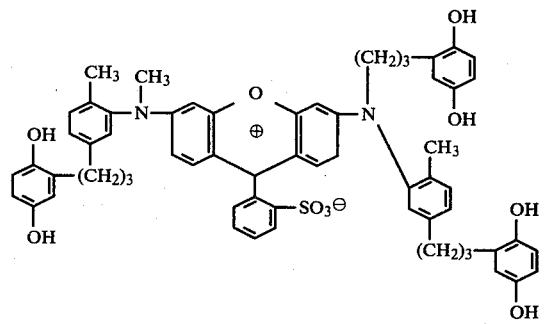

at a coverage of about 20 mg./ft.$^2$ of dye developer and about 30 mg./ft.$^2$ of gelatin. The resolution in the magenta transfer image was determined to be about 40 cycles per millimeter. The image had a maximum reflection density to green light of about 1.40 and a minimum reflection density to green light of about 0.10.

EXAMPLE 3

A film unit was prepared, exposed, and processed for 30 seconds in the manner described in Example 1 and the resolution of the monochromatic transfer image determined in the manner described in that Example. The film unit was identical to that described in Example 1 except that, instead of the yellow dye developer layer, the dye developer element comprised a layer of a gelatin dispersion of a cyan dye developer of the formula

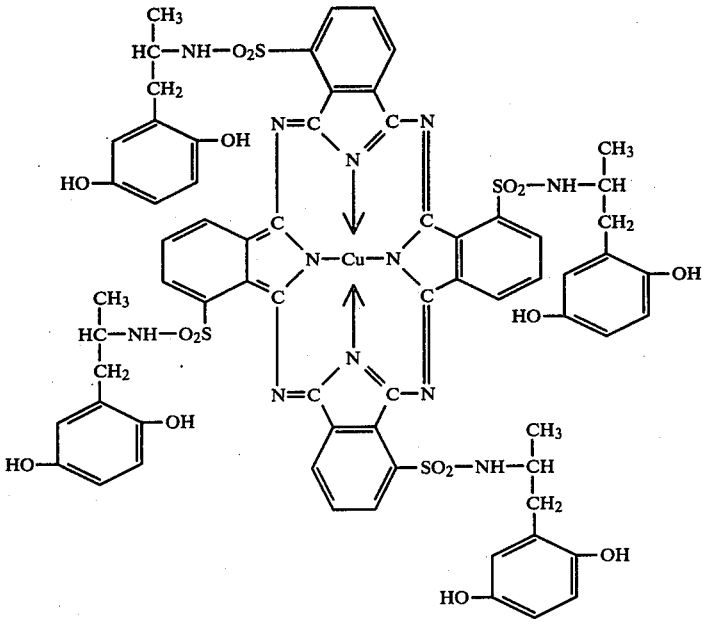

at a coverage of about 50 mg./ft.$^2$ of dye developer and 50 mg./ft.$^2$ of gelatin. The resolution in the cyan transfer image was determined to be about 40 cycles per millimeter. The image had a maximum reflection density to red light of about 1.20 and a minimum reflection density to red light of about 0.20.

EXAMPLE 4

A film unit was prepared, exposed, and processed in the manner described in Example 1 and the resolution of the monochromatic transfer image determined in the manner described in that Example. The film unit was identical to that described in Example 1 except that the strippable layer consisted of a mixture of cellulose acetate hydrogen phthalate (CAHP) and the resinous plasticizer Resoflex-296 at a coverage of about 70 mg./ft.$^2$ of CAHP and about 50 mg./ft.$^2$ of Resoflex-296. The resolution in the yellow transfer image was determined to be about 30 cycles per millimeter. The image had a maximum reflection density to blue light of about 1.25 and a minimum reflection density to blue light of about 0.21.

EXAMPLE 5

For purposes of comparison, a diffusion transfer film unit adapted for diffusion of the imagewise distribution of dye developer across the processing composition layer was prepared. The film unit comprised (a) a photosensitive element comprising the same support material used in Examples 1 to 4 on which were coated, in order, a cyan dye developer layer identical to that employed in Example 3, an anti-halation layer, a silver halide emulsion layer, and a gelatin layer, all of which were identical to those employed in Examples 1 to 4; (b) an image-receiving element comprising the same support material used in Examples 1 to 4 on which was coated an image-receiving layer identical to that employed in the above Examples; and (c) a rupturable container retaining the same processing composition employed in the above Examples. The photosensitive element was given a 2 meter-candle-second exposure from the emulsion side through the resolution target described above. Subsequent to exposure, the photosensitive and image-receiving elements were superposed in face-to-face relation with their respective supports outermost and with the rupturable container positioned transversely therebetween and closely adjacent a leading edge thereof. The film unit was passed through a pair of pressure rollers positioned at a distance of about 0.0018 inch to effect rupture of the container and distribution of the processing composition between the superposed elements. After imbibition at room temperature for about 30 seconds, the image-receiving element was stripped away from the photosensitive element. The resolution of the resultant cyan transfer image, as determined in the manner described above, was about 15 cycles per millimeter. The maximum and minimum image densities were, respectively, 1.22 and 0.74.

It should be understood that characterization of the resolution provided by the film units of this invention as "relatively high" is intended to indicate that such resolution is high in comparison to that provided by diffusion transfer film units in general and particularly in comparison to that provided by such film units adapted for separation subsequent to processing and for transfer of the image-wise distribution of dye developer across the processing composition layer.

The novel film units provided by this invention are particularly suitable for various graphic arts applications, e.g., color proofing. This is particularly so where the positive image is on a transparent support.

It will be recognized that the novel construction of the film units of this invention permits one to obtain images of various colors while using only a single type of photosensitive element. In this embodiment, the silver halide emulsion is panchromatically sensitized and, thus, may be exposed by a plurality of different wavelength ranges appropriate for different color developers to provide complementary color images.

It will be recognized that the color of the dye developer need not be complementary to the sensitivity range of the photosensitive element.

Since certain changes can be made in the above products and processes without departing from the scope of the present invention, it is intended that all matter contained in the above description shall be interpreted as illustrative and not limitative.

What is claimed is:

1. A diffusion transfer film unit comprising:

a photosensitive element comprising a first support carrying on one surface, in order, an alkaline solution permeable image-receiving layer, a strippable layer which permits separation of said image-receiving layer and said first support, as a unitary structure, from said film unit after processing thereof, and a photosensitive silver halide emulsion layer;

a dye developer element comprising a second support carrying at least one dye developer layer, said dye developer element and said photosensitive element superposed or adapted to be superposed with said first and second supports outermost; and a rupturable container retaining an aqueous alkaline processing composition and fixedly positioned to effect, upon rupture, discharge of said processing composition between said photosensitive element and said dye developer element.

2. A film unit of claim 1 further comprising an anti-halation layer contained in either said photosensitive element or said dye developer element.

3. A film unit of claim 2 wherein said anti-halation layer is contained in said photosensitive element.

4. A film unit of claim 3 wherein said anti-halation layer is positioned in said photosensitive element between said silver halide emulsion layer and said strippable layer.

5. A film unit of claim 3 wherein said first support is transparent and said anti-halation layer is positioned in said photosensitive element on that side of said silver halide emulsion layer opposite said first support.

6. A film unit of claim 2 comprising said photosensitive element and said dye developer element in superposition, wherein said first support is transparent and said dye developer element comprises said anti-halation layer.

7. A film unit of claim 1 further comprising an auxiliary developing agent.

8. A film unit of claim 7 wherein said auxiliary developing agent comprises a hydroquinone moiety.

9. A film unit of claim 7 wherein said auxiliary developing agent is included, at least in part, in said processing composition.

10. A film unit of claim 1 further comprising an alkali neutralization layer positioned between said first support and said image-receiving layer.

11. A film unit of claim 10 further comprising an alkali neutralization timing layer positioned between said alkali neutralization layer and said image-receiving layer.

12. A film unit of claim 1 further comprising an alkali neutralization layer positioned between said second support and said dye developer layer.

13. A film unit of claim 12 further comprising an alkali neutralization timing layer positioned between said alkali neutralization layer and said dye developer layer.

14. A diffusion transfer film unit comprising:

a photosensitive element comprising a transparent first support carrying on one surface, in order, an alkaline solution permeable image-receiving layer, a strippable layer which permits separation of said image-receiving layer and said first support, as a unitary structure, from said film unit after processing thereof, and a photosensitive silver halide emulsion layer;

a dye developer element comprising a second support carrying at least one dye developer layer, said dye developer element and said photosensitive element adapted to be superposed subsequent to exposure of said photosensitive element with said first and second supports outermost; and a rupturable container retaining an aqueous alkaline processing composition and fixedly positioned to effect, upon rupture, discharge of said processing composition between said photosensitive element and said dye developer element as or after said elements are brought into superposition.

15. A film unit of claim 14 further comprising an anti-halation layer positioned between said strippable layer and said silver halide emulsion layer.

16. A film unit of claim 15 wherein said anti-halation layer comprises an anti-halation dye or pigment dispersed in a carrier which is permeable to and swellable in the presence of said processing composition.

17. A film unit of claim 16 wherein said anti-halation layer comprises a dispersion of carbon black in gelatin.

18. A film unit of claim 14 further comprising an auxiliary developing agent.

19. A film unit of claim 18 wherein said auxiliary developing agent comprises a hydroquinone moiety.

20. A film unit of claim 19 wherein said auxiliary developing agent is trimethylhydroquinone.

21. A film unit of claim 18 wherein said auxiliary developing agent is included, at least in part, in said processing composition.

22. A film unit of claim 14 further comprising an alkali neutralization layer positioned between said first support and said image-receiving layer.

23. A film unit of claim 22 further comprising an alkali neutralization timing layer positioned between said alkali neutralization layer and said image-receiving layer.

24. A film unit of claim 14 further comprising an alkali neutralization layer positioned between said second support and said dye developer layer.

25. A film unit of claim 24 further comprising an alkali neutralization timing layer positioned between said alkali neutralization layer and said dye developer layer.

26. A film unit of claim 14 wherein said dye developer layer comprises a dispersion of a dye developer in a polymeric binder which is permeable to and swellable in the presence of said processing composition.

27. A film unit of claim 26 wherein said dye developer layer comprises a dispersion of a dye developer in gelatin.

28. A film unit of claim 14 wherein said photosensitive element further comprises a protective overcoat layer.

29. A process comprising the steps of exposing the silver halide of a photosensitive element comprising a first support carrying on one surface, in order, an alkaline solution permeable image-receiving layer, a strippable layer permitting separation of said image-receiving layer and said first support, as a unitary structure, from said film unit after processing thereof, and a photosensitive silver halide emulsion layer;

distributing an aqueous alkaline processing composition between said photosensitive element and a dye developer element in superposition with said photosensitive element and comprising a second support carrying at least one dye developer layer;

dissolving at least a portion of the dye developer in said dye developer layer in said processing composition;

transferring at least a portion of the dissolved dye developer to said photosensitive element in an essentially uniform distribution;

substantially immobilizing the dye developer in said uniform distribution as a function of development of said silver halide, thereby forming an imagewise distribution of diffusible dye developer;

transferring at least a portion of said imagewise distribution of diffusible dye developer to said image-receiving layer to provide a monochromatic transfer image therein; and separating said image-receiving layer and said first support, as a unitary structure, from said film unit.

30. A process of claim 29 wherein said silver halide is exposed from the emulsion side of said photosensitive element and said photosensitive element and said dye developer element are brought into superposition subsequent to exposure.

31. A process of claim 29 further comprising reacting at least a portion of the alkali of said aqueous alkaline processing composition with an immobile acid reactive agent in alkali neutralization layer contained in said photosensitive element or said dye developer element to effect downward adjustment of the environmental pH of said image-receiving layer to a pH of at least 11 or lower.

* * * * *